United States Patent [19]

Ennis, III

[11] Patent Number: 4,923,096

[45] Date of Patent: May 8, 1990

[54] DRIPLESS AUTOMATIC SYRINGE FOR DISPENSING FLUIDS

[75] Inventor: James F. Ennis, III, Preston, Conn.

[73] Assignee: Mark L. Anderson, Elmwood, Wis.

[21] Appl. No.: 295,149

[22] Filed: Jan. 9, 1989

[51] Int. Cl.[5] ..... B67D 5/42

[52] U.S. Cl. ..... 222/391; 222/326; 222/108; 222/571

[58] Field of Search ..... 222/386, 391, 326, 327, 222/108, 109, 325, 571

[56] References Cited

U.S. PATENT DOCUMENTS

| | | | |
|---|---|---|---|
| 2,768,768 | 10/1956 | Cornell et al. | 222/391 |
| 4,461,407 | 7/1984 | Finnegan | 222/391 |
| 4,681,524 | 7/1987 | Ikeda et al. | 222/391 |

*Primary Examiner*—Joseph J. Rolla
*Assistant Examiner*—Kenneth Noland
*Attorney, Agent, or Firm*—Edward H. Loveman

[57] ABSTRACT

This dripless automatic syringe for dispensing fluids has a barrel for containing the fluid, a nozzle for discharging the fluid, and a housing to which the barrel is attached. A piston rod in the housing carries a rigid sealed piston head in the barrel for pushing out the fluid. Behind the piston head a normally unflexed elastic disc in the housing. The disc flexes when the piston rod moves forwardly under a driving force. The disc unflexes to retract the piston rod and piston head slightly when the driving force stops to create a suction which draws fluid back into the nozzle and thereby prevents dripping. The disc has an integral nipple which frictionally grips the rod to hold it in place, when the driving force ceases. The nipple permits axial rearward movement of the piston rod by an externally applied force for filling the barrel with fluid.

5 Claims, 3 Drawing Sheets

DRIPLESS AUTOMATIC SYRINGE FOR DISPENSING FLUIDS

BACKGROUND OF THE INVENTION

1. Field of the Invention

This invention relates to the art of automatic syringes, caulking guns, and similar devices used for dispensing repeatedly, precise, measured doses of liquid or other fluids from a barrel containing the liquid; and more particularly, the invention involves means for preventing dripping of liquid from the syringe after each dose is dispensed.

2. Background of the Invention

In my prior U.S. Pat. No. 4,678,107, I introduced the concept of adapting a syringe to prevent dripping, by providing an elastic concave disc or cap at the end of the plunger rod. The cap flattens out during discharge of liquid from the barrel. When forward driving movement of the plunger rod ceases, the cap reassumes its concave form to create a suction which draws and holds the liquid in the barrel to prevent dripping. When a syringe having a rigid seal or a pivoting stop at the driving end of the plunger rod is used, the elastic cap described in my prior patent above mentioned cannot be used. The use of a solid, rigid seal or pivotal stop at the end of the plunger is highly desirable to insure positive ejection of a required dose from the syringe. The present invention seeks to avoid replacing the solid seal in an automatic syringe by an elastic one because of the better control afforded when many doses are administered one after the other from an automatic syringe; and because it is desirable to keep the liquid in the barrel from contacting the elastic cap.

BRIEF DESCRIPTION OF THE INVENTION

The present invention is primarily directed at overcoming the objectionable dripping of the liquid or other fluid from a syringe having a solid plunger seal to insure administration of repeated, precise measured doses from the syringe. According to the invention an elastic, annular disc or flange is mounted inside the syringe housing rearwardly of a tubular barrel containing fluid to be dispensed, and rearwardly of a cylindrical piston head which has a rigid, flat, forward, circular face for driving the fluid. A plunger rod extends through a central elastic nipple integral with the elastic disc. The nipple frictionally grips the piston rod but is slidable thereon. The periphery of the forward side of the elastic flange nests in a circumferential bevel formed at the rear side or edge of a nut holding the barrel on the syringe. When the plunger rod is moved forwardly to eject a measured dose of fluid from the barrel, the elastic disc flexes to assume a convex form at the beveled rear end of the nut, while the nipple slides axially on the plunger rod. When the plunger rod stops moving forwardly the flexed elastic flange reassumes its normal flat configuration and with the nipple slightly retracts the plunger rod to draw a suction at the open dispensing end of the barrel. This results in withdrawal of the fluid from the nozzle or open end of the barrel, and thus prevents dripping of the fluid from the syringe. The elastic disc and nipple perform the further function of holding the plunger rod in place axially of the barrel for dispensing the next measured dose.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
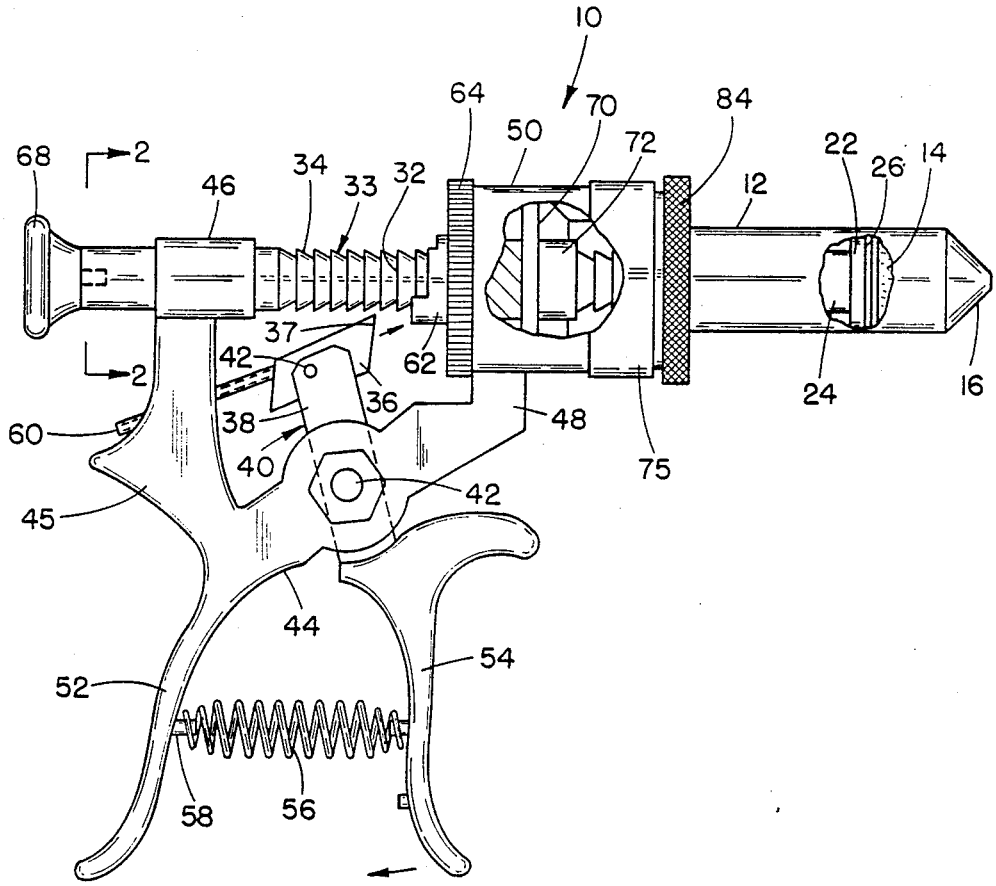
FIG. 1 is a side elevational view of an automatic syringe embodying the invention, with portions broken away to show parts of the invention inside the syringe.
Figure 2:
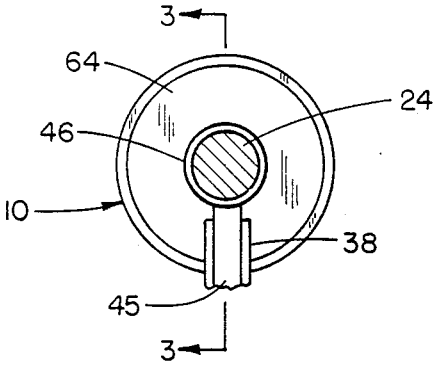
FIG. 2 is a fragmentary cross sectional view taken along line 2—2 of FIG. 1.
Figure 3:
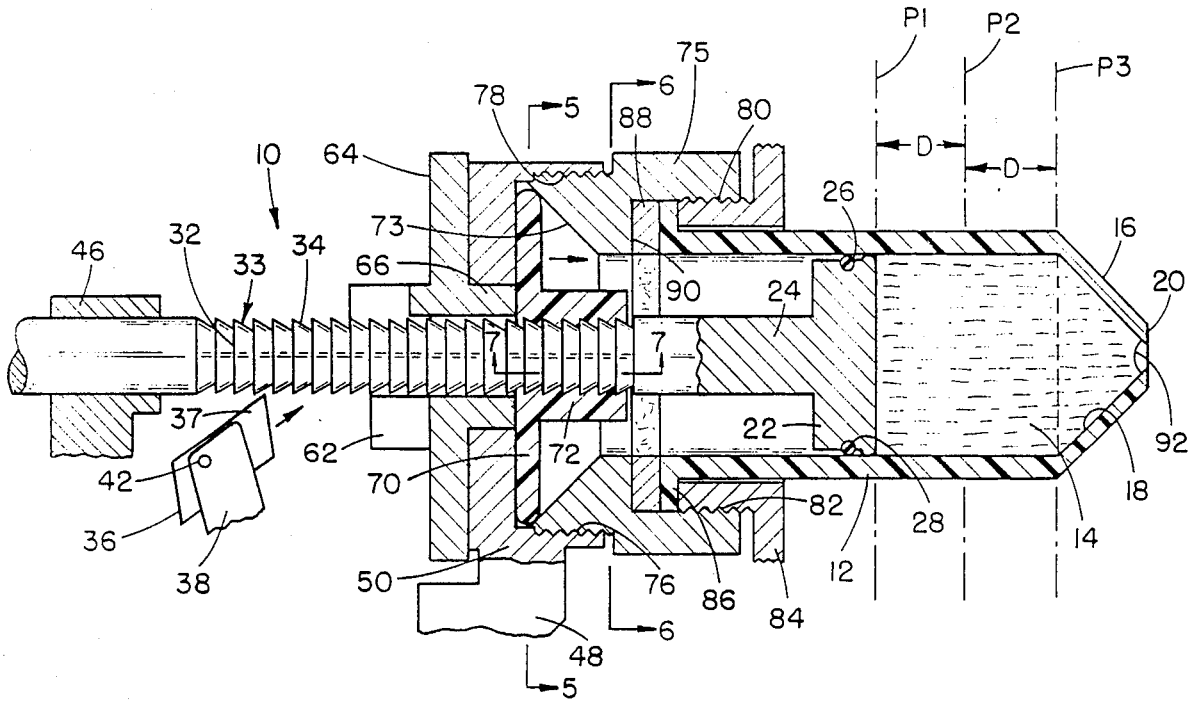
FIG. 3 is a fragmentary enlarged central sectional view taken along line 3—3 of FIG. 2, showing the elastic disc unflexed, and the plunger rod in position for dispensing fluid from the syringe.
Figure 4:
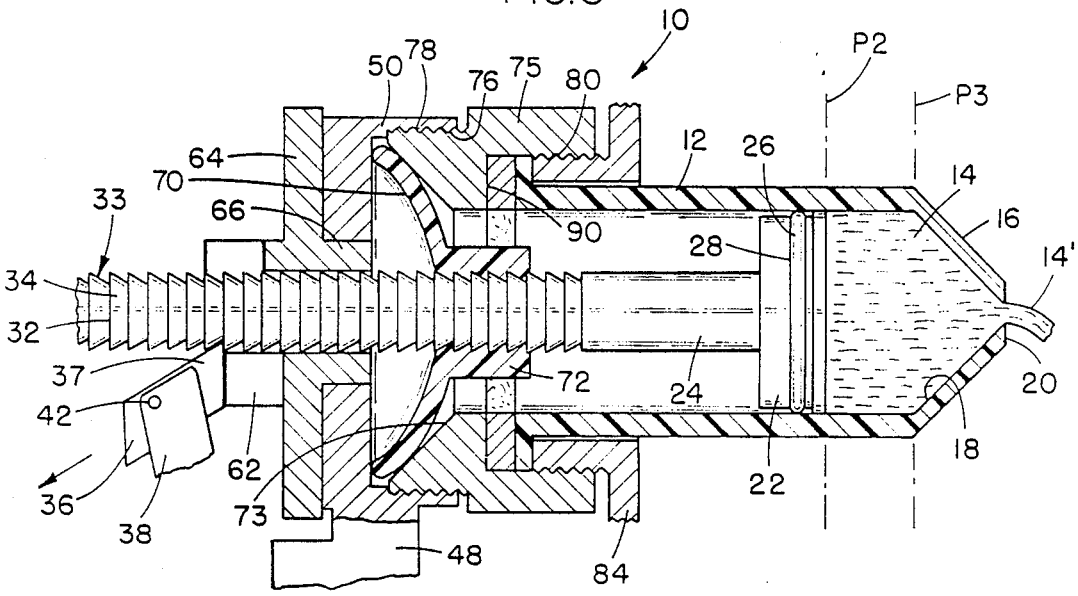
FIG. 4 is a fragmentary sectional view similar to a portion of FIG. 3, showing the elastic disc in flexed condition as the plunger rod finishes discharging a dose of fluid from the syringe.
Figure 7:
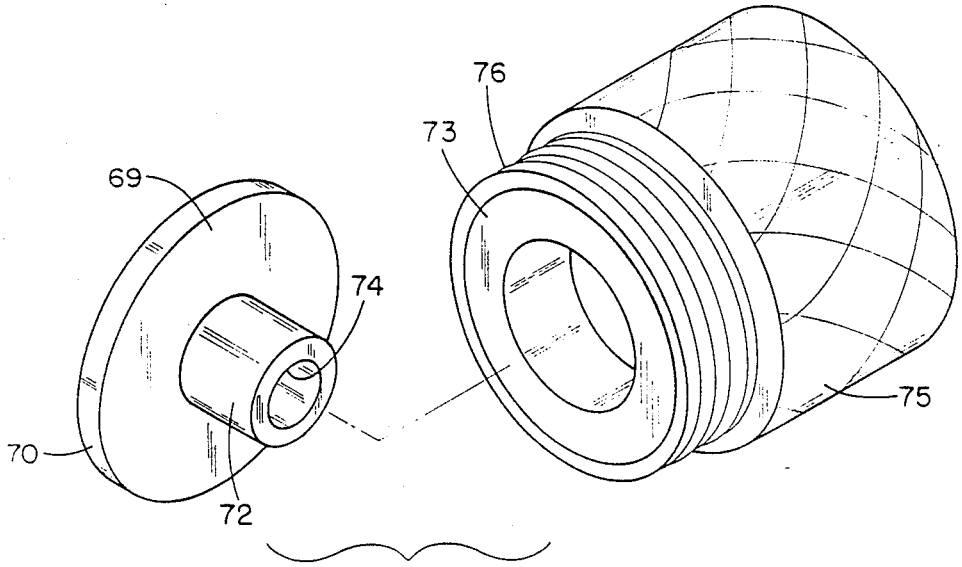
FIG. 7 is an exploded enlarged perspective view of the elastic disc and beveled nut employed in the syringe of FIGS. 1-4.
Figure 5:
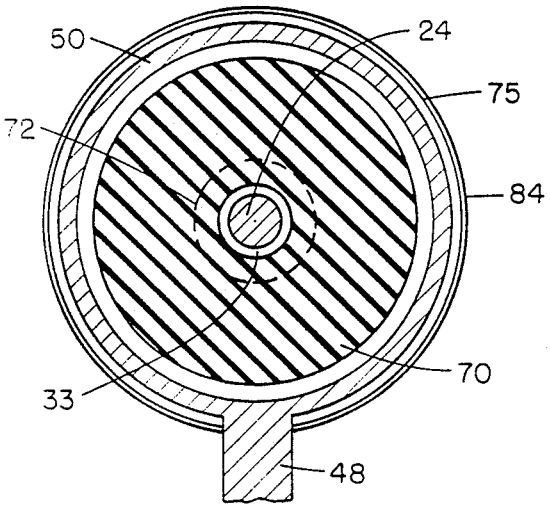
FIGS. 5 and 6 are cross sectional views taken along lines 5—5 and 6—6 respectively of FIG. 3.
Figure 6:
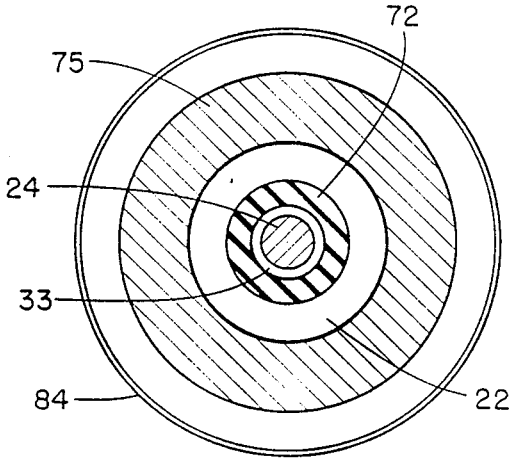

Referring now to the drawings wherein like reference characters designate like or corresponding parts throughout, there is illustrated in FIGS. 1-4, a syringe generally designated as reference numeral 10 having a cylindrical barrel 12 for containing a fluid 14 to be dispensed from a nozzle 16 at the forward end of the barrel 12. As best shown in FIGS. 3 and 4 the nozzle 16 has a tapered passage 18 open at its free end 20 out of which the fluid 14 flows as a stream 14'.

Figure 8:
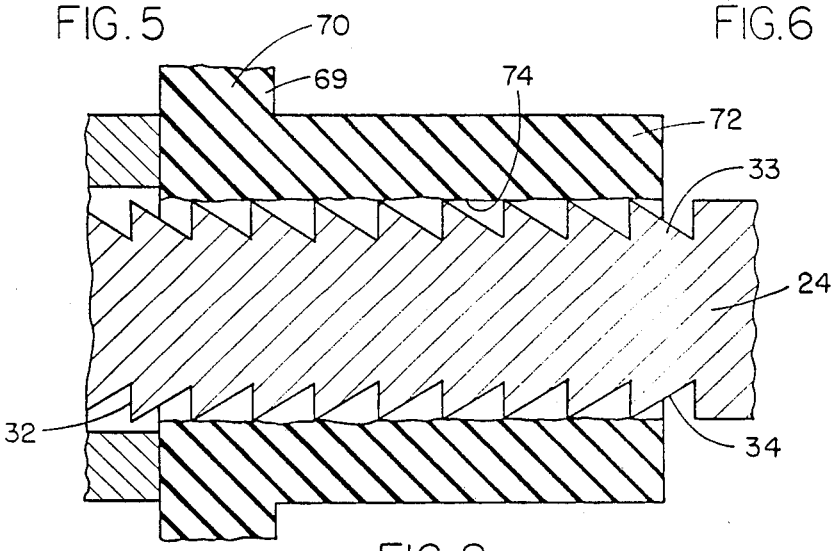
FIG. 8 is a further enlarged fragmentary longitudinal sectional view taken along line 8—8 of FIG. 3.

The syringe further comprises a flat, solid, circular piston head 22 at the forward end of a central, axial piston rod 24. An O-ring 26 is set in a circumferential groove 28 in the piston head 22 to prevent rearward passage of the fluid in the barrel 12 and to insure positive forward driving pressure on the fluid 14. The piston rod 24 extends axially of the barrel 12 rearwardly. The rod 24 is formed with a series of circumferential grooves defining ridges 33 each of which has a flat, annular face 32 facing rearwardly and a frustoconical side 34 facing forwardly; see FIG. 8. These annular ridges 33 can be engaged one at a time by a pawl 36 having a sharp tooth 37 for moving the rod 24 forwardly axially of the barrel; i.e. to the right as viewed in FIGS. 1, 3, 4.

The pawl 36 is pivotally mounted between spaced fingers 38 at the upper end of a lever 40 which is pivotally carried by a pin 42 supported by a stationary bracket 44. The bracket 44 has a rear arm 45 to which is integrally joined a collar 46 through which the rod 24 is axially movable both forwardly and rearwardly, i.e. right and left as viewed in FIG. 1. The bracket 44 has a forward stationary arm 48 integrally joined to an internally threaded stationary cup 50. The bracket 44 has an integrally joined curved stationary handle 52 extending downwardly and rearwardly from the bracket 44. The lower end of the pivotable lever 40 is formed as a curved finger grip or handle 54 and is biased away from the handle 52 by a coil spring 56 each end of which is engaged on a pin 58 extending from one of the handles 52,54.

The pawl 36 is normally held clear of the ridges 33 and in abutment with an adjustment screw 60 in the bracket arm 45, while the handle 54 extends downwardly and forwardly all under the expansion bias of the spring 56. It will be apparent from the above description that the piston rod 24 may be advanced by engagement of the pawl 36 with the nearest ridge 33. While the handle 54 is moved rearwardly clockwise as viewed in FIG. 1, the pawl 36 will be driven clockwise forwardly to advance the rod 24 axially for a limited precisely measured distance. The distance the pawl 36 moves is determined by the circumferential location of any one of a plurality of differently sized axial abutments 62 carried by a disc 64 connected to a sleeve bearing 66 and rotatably carried by the stationary cup 50. In order to move the rod 24 axially rearwardly it must be pulled manually through a bearing 66 and through the collar 46. A knob 68 threaded on the rear end of the rod 24 facilitates manually pulling the rod 24 axially.

To the extent hereinabove described, the syringe construction is largely conventional. Now according to the invention there is provided an elastic, flat annular disk 70 best shown in FIGS. 1 and 3–8 which can be made of rubber, plastic or suitable composition material. Extending axially from a forward face of 69 of the disc 70 and integral therewith is an elastic cylindrical nipple 72. The diameter of a bore 74 in the nipple 72 is slightly less than the external diameter of the rod 24, so that the nipple 72 frictionally grips the rod ridges 33 of the rod 24 (see FIG. 8) but can slide on the rod 24. The nipple 72 slides on the rod 24 to permit the rod 24 to be drawn axially forwardly for dispensing the fluid 14 and rearwardly when the barrel 12 is being filled with fluid 14. The periphery of the elastic disc 70 normally nests in a conical circumferential beveled end or edge 73 of a stationary nut 75 which has a rear external threading 76 to engage the internal thread 78 of the cup 50. The nut 75 has forward internal threading 80 which engages a rear threading 82 on a forward nut 84 which engages an annular flange 86 at the rear end of the barrel 12 and presses the flange 86 against a washer 88 seated against a shoulder 90 the nut 75. The cup 50 and the nuts 75 and 84 define the cylindrical housing of the syringe 10.

By the arrangement described there is provided a rigid syringe structure which can be readily disassembled by disengaging the housing nuts 84 and 75 and the cup 50. It will be noted in FIGS. 3, 4 and 8 that the nipple 72 extends axially forwardly frictionally gripping the rod 24. This is well rear of the piston head 22 providing a solid seal for the fluid 14 in the barrel 12. Suppose now that the handles 52 and 54 are manually gripped and that the handle 54 is retract rearwardly, this will cause the pawl 36 to engage the nearest ridge 33 to advance the rod 24 until pawl 36 engages one of the abutments 62 on the disc 64. As the rod 24 advances a set distance D, a precisely measured dose or volume of fluid 14 is expelled from the nozzle 16. At the same time as shown in FIG. 4 the disc 70 flexes to assume a forwardly convex position in the beveled rear edge 73 of the nut 75. The nipple 72 slips to allow the rod 24 to move forwardly while maintaining frictional engagement therewith. During the period the piston head 22 moves forwardly the distance D from the fixed position Pl shown in FIG. 3 to a position P2 indicated by dotted lines (in FIGS. 3 and 4) the disc 70 remains in the flexed condition shown in FIG. 4. After the handle 54 is released, the pawl 36 disengages from the rod 24 and the rod remains in place at the position P2 as indicated in FIG. 4. At the same time fluid flow 14' stops and the flexed disc 70 reassumes its flat position shown in FIG. 3. This causes a slight backward or negative pressure or suction which causes a concave meniscus 92 to form by capillarity at the opening 20 in nozzle 16; see FIG. 3. This stops and prevents dripping and leakage of the fluid at nozzle opening 20.

The showing of flexure of the disc 70 in FIG. 4 is rather exaggerated in order to illustrate more clearly the mode of operation of the invention. Actually the flexure of the disc 70 is slight and only enough to retract the rod 24 less than the axial length of one of the ridges 33, so that a small meniscus 92 can be formed. The nipple 72 then remains fixed on the rod 24. The extent of retraction, movement of the nipple 72 is exaggerated in FIGS. 3 and 4 to illustrate the mode of operation of the invention. When next the handle 54 is moved clockwise rearwardly as indicated in FIG. 4, the piston head 22 will resume forward axial movement from the position P2 indicated in FIGS. 3 and 4, and will advance to a position P#. The distance D will always be the same, unless the circumferential position of the disc 64 is changed to position the abutment 62 of different axial length in front of pawl 36.

From the foregoing description of the structure it will be apparent that this automatic syringe 10 will not drip or leak due to the action of the disc 70 guided by the beveled edge 73 of the nut 75, which slightly retracts the piston head 22 after each dose of fluid 14 is discharged.

It is of course possible to provide other forms of nozzles 16, hollow needles, etc. at the open end 20 of the barrel 12. In any event the piston head 22 will present a solid seal to the fluid 14 at all times. Any liquid suitable for dispensing by the syringe or a caulking gun can be used. Even a highly viscous fluid can be used such as putty, paste, paint, glue, grease, etc. In any event, the invention insures that the elastic disc 70 remains out of contact with the fluid 14 at all times, while insuring that no fluid drips from the barrel 12 occur, after manual pressure on the finger grip or handle 54 is released.

It should be understood that the foregoing relates to only a preferred embodiment of the invention which has been by way of example only, and that it is intended to cover all changes and modifications of the examples of the invention herein chosen for the purpose of the disclosure, which do not constitute departures from the spirit and scope of the invention.

What is claimed is:

1. A fluid dispensing device, comprising:

a cylindrical barrel for containing a fluid to be dispensed, said barrel having forward and rear open ends;

a nozzle at said forward end of said barrel and having an open free end for discharging said fluid from said barrel;

an elongated rod having a forward end insertable axially into said barrel;

a rigid piston head on said forward end of said rod for driving said fluid out of said barrel through said nozzle each time an axially forward driving force is applied to said rod to move the same axially of said barrel;

a normally unflexed elastic means said elastic means comprising a flexible nipple fractionally gripping said rod rearwardly of said piston head, to hold said rod in place each time said driving force applied to said rod ceases and a flexible disc integral with said nipple for slightly retracting said rod each time said rod ceases driving said piston head forwardly in said barrel and flexible disc arranged to flex when said rod is driven forwardly to discharge said fluid from said barrel, said flexible disc being further arranged to resume unflexed condition when said driving force ceases, to create a suction at said open free end of said nozzle to draw back fluid thereat into said nozzle to prevent dripping of said fluid from said nozzle; and stationary means defining a recess adjacent to said flexible disc for receiving flexed portions thereof each time said driving force advances said plunger forwardly in said housing and said barrel.

2. A fluid dispensing device comprising:

a generally cylindrical housing;

a cylindrical barrel for containing a fluid to be dispensed, said barrel having forward and rear ends, said rear end being attached to said housing;

a nozzle at said forward end of said barrel and having an open free end for discharging said fluid from said barrel;

an elongated rod having a piston rod extending axially of said housing and having a forward end insertable axially into said barrel;

a rigid sealed piston head on said forward end of said piston rod for repeatedly driving a predetermined volume of said fluid out of said barrel through said nozzle each time an axially forward driving force is applied to said rod to move the same axially forward in said barrel;

normally unflexed elastic means in said housing said elastic means comprising a flexible nipple frictionally gripping said piston rod rearwardly of said piston head, to hold the same in place in said housing and said barrel each time said driving force applied to said piston rod ceases, and a flexible disc integral with said nipple to flex when said piston rod is driven forwardly to discharge said fluid from said barrel, said flexible disc being further arranged to resume unflexed condition when said driving force ceases to create a suction at said open free end of said nozzle to draw back fluid thereat into said nozzle to prevent dripping of said fluid from said nozzle; and said housing including a recess means adjacent said flexible disc for receiving flexed portions thereof each time said driving force advances said piston rod forwardly in said housing and said barrel.

3. A fluid dispensing device as defined in claim 2, wherein said recess means comprises a nut forming part of said housing and having a beveled edge defining said recess adjacent to said flexible disc.

4. A fluid dispensing device as defined in claim 2, further comprising mechanical means carried by said housing and arranged to repeatedly drive said piston rod axially forward while said flexible disc flexes and said nipple allows said piston rod to slide axially forward, for repeatedly discharging a predetermined volume of said fluid from nozzle.

5. A fluid dispensing device as defined in claim 4, wherein said nipple exerts sufficient pressure on said piston rod to retract the same slightly and then to hold said rod in place each time said driving force ceases moving said piston rod forwardly, said pressure being such as to permit said rod to be drawn axially rearward by an externally applied force for retracting said piston rod and said piston head while filling said chamber with said fluid.

* * * * *